US007878420B2

(12) United States Patent
Thomas et al.

(10) Patent No.: US 7,878,420 B2
(45) Date of Patent: Feb. 1, 2011

(54) PURGE ARRANGEMENT FOR FAST POWDER CHANGE

(75) Inventors: Michael S. Thomas, Elyria, OH (US); Sergey Guskov, Meerbusch (DE); James V. Bachman, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 161 days.

(21) Appl. No.: 12/094,823

(22) PCT Filed: Dec. 5, 2006

(86) PCT No.: PCT/US2006/061607

§ 371 (c)(1),
(2), (4) Date: May 23, 2008

(87) PCT Pub. No.: WO2007/067891

PCT Pub. Date: Jun. 14, 2007

(65) Prior Publication Data

US 2008/0283630 A1 Nov. 20, 2008

Related U.S. Application Data

(60) Provisional application No. 60/748,512, filed on Dec. 8, 2005.

(51) Int. Cl.
*B05B 15/02* (2006.01)

(52) U.S. Cl. ..... 239/112; 239/79; 239/85; 239/106; 118/326

(58) Field of Classification Search ..... 239/1, 239/104, 106, 112, 79, 85, 650, 654, 113, 239/305; 118/308, 311, 326; 137/565.01
See application file for complete search history.

(56) References Cited

U.S. PATENT DOCUMENTS

| | | | | |
|---|---|---|---|---|
| 4,248,379 | A * | 2/1981 | Hollstein et al. | 239/1 |
| 6,223,997 | B1 * | 5/2001 | Fulkerson et al. | 239/112 |
| 6,705,545 | B1 * | 3/2004 | Sroka et al. | 239/112 |
| 7,074,274 | B1 * | 7/2006 | Shutic et al. | 118/326 |
| 2002/0109018 | A1 | 8/2002 | Vollmer | |
| 2005/0028867 | A1 | 2/2005 | Ciarelli et al. | |

FOREIGN PATENT DOCUMENTS

| | | |
|---|---|---|
| GB | 2416720 | 2/2006 |
| WO | 02/09886 | 2/2002 |
| WO | 2004/050259 | 6/2004 |
| WO | 2007/067891 | 6/2007 |

OTHER PUBLICATIONS

International Search Report from PCT/US06/061607, mailed Mar. 29, 2007.

* cited by examiner

*Primary Examiner*—Steven J Ganey
(74) *Attorney, Agent, or Firm*—Calfee, Halter & Griswold LLP

(57) ABSTRACT

Purge arrangement for powder coating system includes a gun manifold (40) that is selectively assembled for fluid communication with either a purge manifold (36) or a hopper manifold (34). This allows purging of multiple hoses and guns at the same time and simplified color change operations.

18 Claims, 9 Drawing Sheets

PURGE ARRANGEMENT FOR FAST POWDER CHANGE

RELATED APPLICATIONS

This application claims the benefit of pending U.S. provisional patent application Ser. No. 60/748,512 filed on Dec. 8, 2005, for GUN AND HOSE PURGE SYSTEM FOR MULTIPLE POWDER FEED HOPPERS, the entire disclosure of which is fully incorporated herein by reference.

BACKGROUND

Typical powder coating systems use a spray booth for powder overspray containment and recovery, one or more manual or automatic powder spray guns, and a powder coating material supply. Powder pumps are used to draw powder from the supply through associated pump hoses or suction tubes, and then to push the powder from the pumps through associated gun hoses to the spray guns in the spray booth. When it is desired to change the powder coating material, such as the type of powder, color, and so on, it is often necessary to completely purge the spray coating system of the prior powder material before the next powder material is used. This can involve purging the pump hoses, the pumps, the gun hoses and the spray guns.

Presently, each gun hose and associated spray gun are manually purged. Each gun hose is purged by individually disconnecting each gun hose from its pump and using a blow gun or wand to blow pressurized air through the gun hose and spray gun. After purge is complete, the gun hose is manually reconnected at one end to its spray gun and at its opposite end to a pump associated with the next powder supply to be used. While each hose/gun pair may take a few seconds to purge out, some coating systems use many guns and so the manual purging operation represents a significant time delay for powder change. This consequently results in costly downtime of the overall coating system.

For example, a bicycle manufacturer may want to sell white, black, red, blue, yellow and green bicycles. Such a manufacturer would need a separate supply, or hopper, for each color of powder. If bicycles were being painted red, for example, the hoses of the powder spray guns would be connected to powder pumps on the red power hopper so that red powdered paint would be supplied from the red powder hopper to all the spray guns. The powder pumps would typically be carried on the lid of the hopper and would travel with the hopper.

If, for example, the manufacturer next wanted to paint a run of bicycles blue, the red powder hopper would be disconnected from the hoses, each of the hoses and spray guns would be cleaned of any red colored powder, and then the hoses would be connected to the pumps on the blue powder hopper so that the blue powder could be supplied to the spray guns. In a system having twenty-four spray guns, for example, that means that all twenty-four hoses and spray guns would have to be individually cleaned during the color change process.

SUMMARY OF THE DISCLOSURE

In accordance with one inventive aspect of the present disclosure, a purge arrangement for a powder coating system is contemplated that allows two or more outlets or flow paths to be purged, optionally at the same time, by a configuration that is selectable between a purge configuration and a supply configuration. Further optionally, the configuration may include a second or more supply so as to facilitate change of powder material. In one embodiment of this inventive aspect, a first manifold, such as a change manifold for example, may selectively be in fluid communication with a supply manifold for a powder coating operation or a purge manifold for a purge operation. Optionally, the first manifold may selectively be in fluid communication with a second supply manifold for a second powder coating operation, thus effecting powder color or material change. In a more specific embodiment with a powder coating system, a gun manifold is connected to a plurality of gun hoses and spray guns, with a hopper manifold being assembled to the gun manifold for a coating operation, and a purge manifold being assembled to the gun manifold for a purge operation. The subcombination of the purge arrangement is considered herein to be an inventive aspect in addition to its combined use in a powder coating system.

The present disclosure also includes a method for purging multiple powder paths with the method including selecting a purge block for fluid communication with a transfer or change block for a purge operation, and selecting a supply block for fluid communication with the transfer or change block for a powder coating system. Optionally, the purge block will purge two or more powder paths at the same time. Still optionally further, a second supply block may be selected for fluid communication with the transfer or change block for a second powder coating operation. This option may be used, for example, to effect powder color or material change with an intermediate purge operation.

These and other inventive aspects and advantages of the disclosure and the inventions described herein will be readily apparent to those skilled in the art from a reading of the following detailed description of exemplary embodiments in view of the accompanying drawings.

DETAILED DESCRIPTION OF EXEMPLARY EMBODIMENTS

Figure 1:
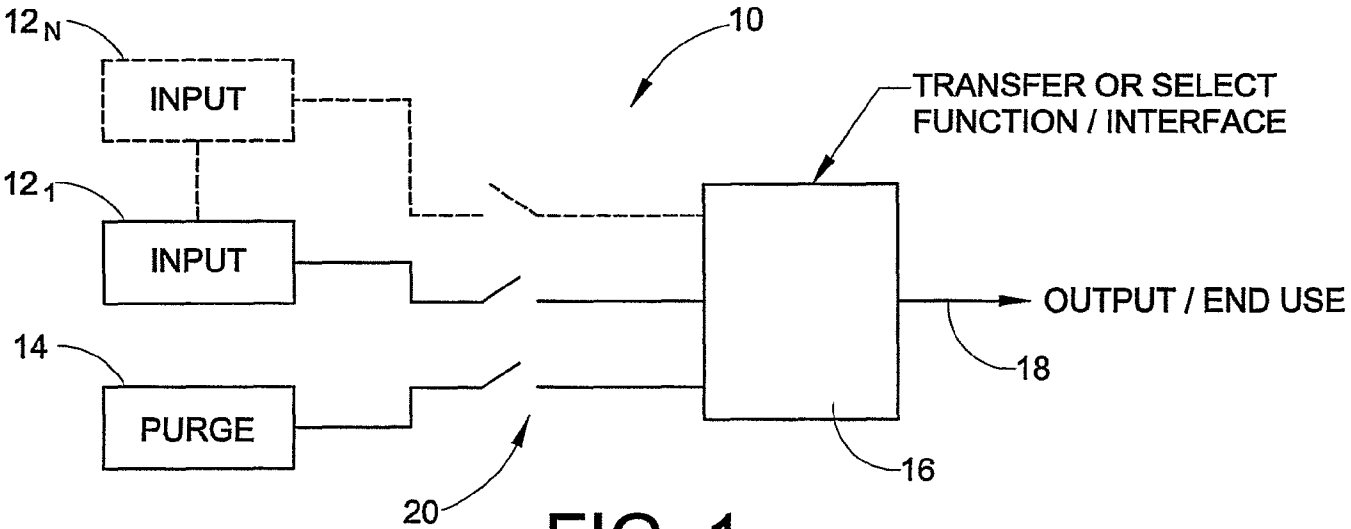
FIG. 1 is a functional and operational block diagram of a first embodiment.

With reference to the drawings, various inventive aspects and features of the disclosure are described by reference to a powder coating application system, however, some or all of the inventive aspects and features may find use or application for many dry particulate materials beyond just powder coating materials and powder coating applications such as spraying. The specific exemplary components of the system are optional and may be modified as needed for a particular application. For example, many types of spray booths are available as well as different spray guns. Powder application may be electrostatic or non-electrostatic, or in some cases a combination of the two. Application techniques may also include manual, automatic or both. The present disclosure is more broadly directed to reducing material change times by providing purge apparatus and methods that are especially but not exclusively beneficial for material application systems having a plurality of application devices and feed hoses.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

Figure 2:
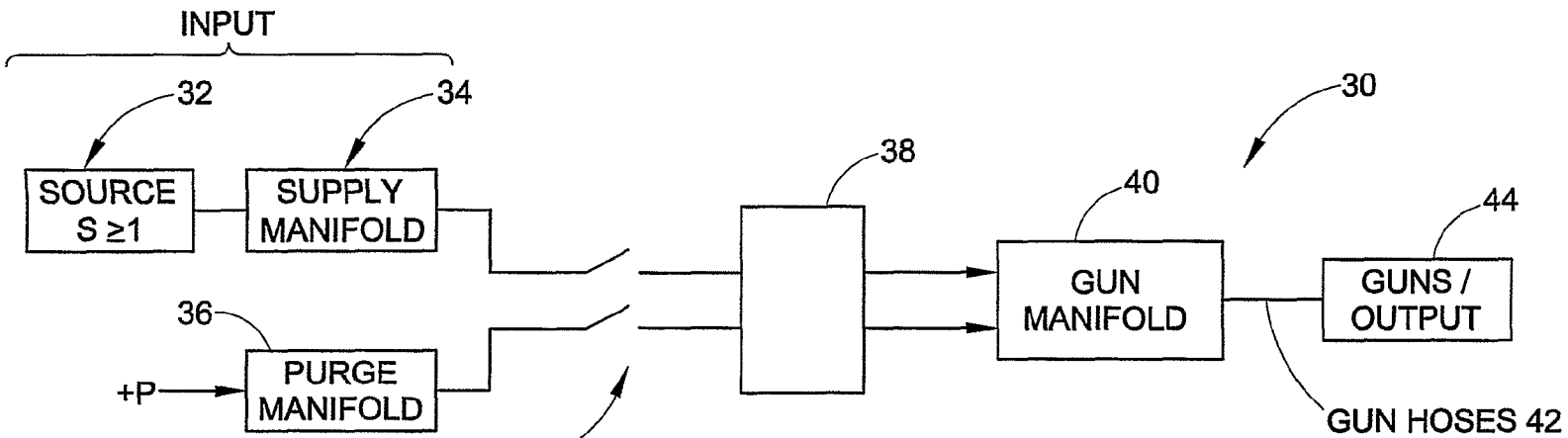
FIG. 2 is a functional and operational block diagram of another embodiment.
Figure 3:
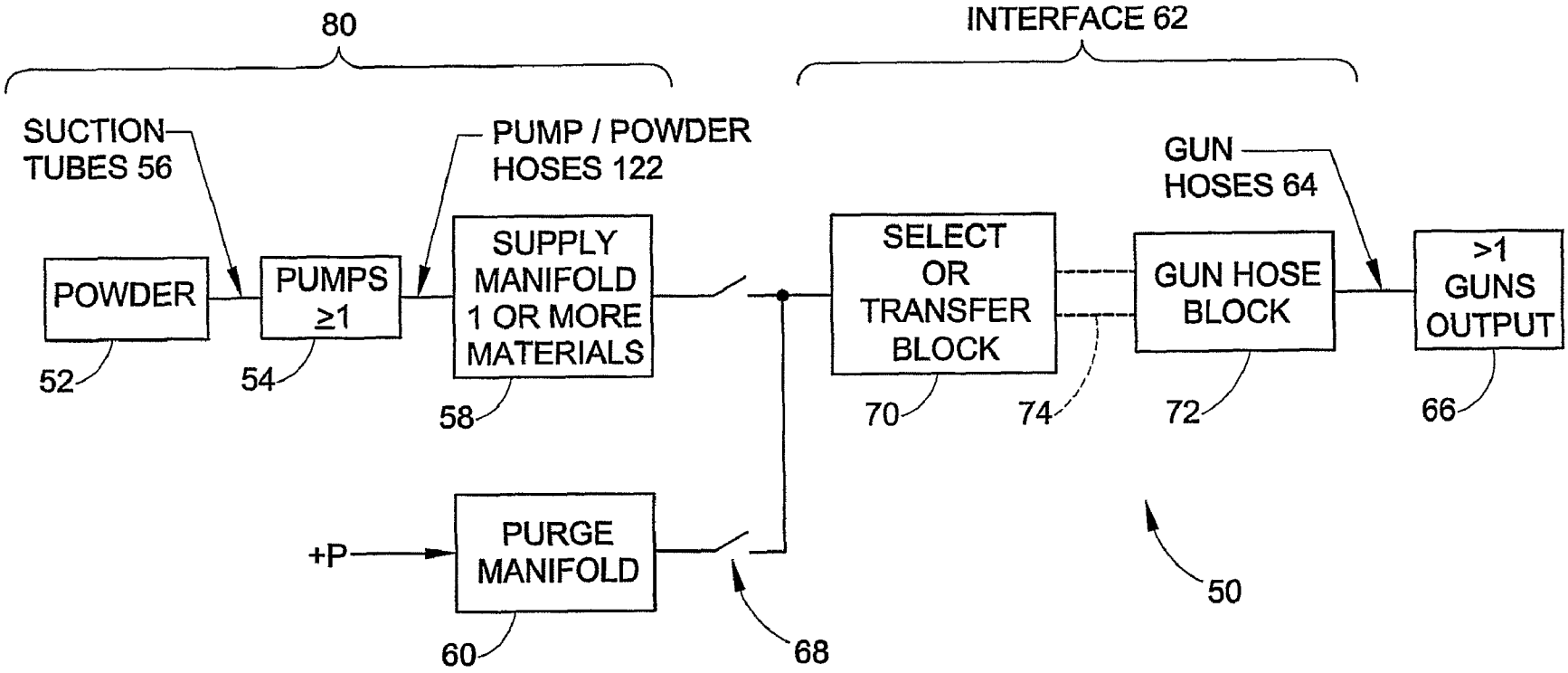
FIG. 3 is a functional and operational block diagram of another embodiment.

With reference to FIGS. 1-3, the general concepts and embodiments of a purge arrangement 10 are shown in simplified schematic form. In a basic form such as FIG. 1, the purge arrangement 10 is shown configured for a plurality of N inputs $\mathbf{12}_N$. An input 12 may be, for example, any source of a powder or dry particulate material, such as a powder coating material. In one embodiment (see FIG. 4 for example) the input 12 may be a feed hopper and a plurality of pumps such as Venturi pumps as are well known by those skilled in the art of powder coating application systems. However, the purge arrangement 10 is not limited to such embodiments of an input 12. Each of the N inputs 12 may further represent a wide variety of different materials used in an application system. A typical but not limiting use would be inputs of N different colors or types of powder coating material, or as another example, light and dark colors.

The purge arrangement 10 concept further includes a purge function 14 which may be for example any suitable or conveniently available source of pressurized air or other suitable purge gas.

The purge arrangement 10 further includes a transfer or select function 16 by which an operator or user selects, at any given time, either one or more of the N inputs 12 for fluid communication to an output or end use such as a coating operation, or the purge function 14 for a purge operation or flow communication to the output or end use. The transfer or select function 16 in one embodiment provides an interface for fluid communication between an output or end use 18 and the selected input $\mathbf{12}_N$ or purge function 14. In the exemplary embodiments herein, the transfer or select function 16 may be realized with a manual interface between manifolds, for example, to provide the desired fluid communication and flow paths. The illustration of switches 20 in FIGS. 1-3 is intended to represent in a simplified manner the selection function such as a manual operation to interface an input 12 or purge 14 to the output 18 via an interface 16.

In this specification, the term manifold is to be understood very broadly as any device or structure that defines multiple flow paths there through. An example is a block of material having passageways through which material can flow along a path from an one or more inlets to one or more outlets. A manifold may be a single piece block or may be a multi-piece structure including blocks, hoses or other components that define various flow paths. A manifold as used herein may be assembled with other manifolds, hoses or other components to provide a flow path or a portion of a flow path.

FIG. 2 illustrates an overview of an exemplary embodiment of a purge arrangement used in combination with a material application system 30. In this exemplary configuration, a number of S sources 32 ($S \geqq 1$) share a common manifold 34 (also called a hopper or supply manifold herein), and positive purge pressure +P is provided by a purge function 36. A suitable select function or interface 38 is provided to select the supply manifold 34 or purge function 36 for fluid communication with a gun manifold 40 (a gun manifold is an exemplary embodiment of a change manifold). The gun manifold 40 provides a plurality of outlets, for example, via gun hoses 42 to a plurality of spray guns 44 or other end use or output. The example of FIG. 2 represents the source 32 as an example of one of the N inputs of FIG. 1, wherein the input provides one or more sources to a common manifold 34. For example, a source 32 may include a plurality of pumps with associated pump hoses in order to supply material to a plurality of spray guns. Thus, in FIG. 2, the combination of the source 32 and supply manifold 34 embody an input 12 of FIG. 1. A flow path is thus provided from each source S to its respective output such as one of the guns 44. However, it is not necessary that there be an exact one to one correspondence between the number of sources S, the number of flow paths and the number of outputs 44. For example, manifolds may be designed to combine or split various flow paths as needed for particular applications.

By "change" manifold is meant a block, manifold or other suitable flow path device that allows an operator to change configuration between a supply configuration—by establishing fluid communication between a supply manifold and the change manifold—or a purge configuration—by establishing fluid communication between a purge manifold and the change manifold to permit purging of multiple flow paths to an output or end use, optionally at the same time. In the exemplary embodiments, the output or end use is realized in the form of two or more spray guns, but many other end uses and outputs for the purge/source selection may be used.

FIG. 3 illustrates in greater detail an exemplary embodiment of a purge arrangement in combination with or for use with a powder coating application system 50. In this configuration, a powder source 52 supplies powder coating material for a series of pumps 54 via suction tubes 56, for example. The pumps 54 may share a common or supply manifold 58. A purge manifold 60 for positive pressure +P purge gas is also provided. An interface arrangement 62 may be provided by which fluid communication is selectively established between a supply manifold 58 or the purge manifold 60 and a plurality of gun hoses 64 and associate guns 66 (more generally stated, an output or end use). As in FIGS. 1 and 2, a manual selection function or operation is schematically represented by switches 68.

In the configuration of FIG. 3, the interface 62 is an exemplary realization of the select or transfer function 16 (FIG. 1) and 38 (FIG. 2). The interface 62 may be, for example, a manifold, a multiple flow path device, or a change block such as a transfer block 70 and a gun hose block 72. The dashed lines 74 represent that the transfer block 70 and gun hose block 72 may optionally be a single block body, two assembled block bodies or two or more bodies that are in fluid communication with each other. The actual configuration chosen for a particular application may take many different forms. A salient but not exclusive inventive feature is that an operator may purge all of the gun hoses 64 and guns 66 (optionally all at the same time) by establishing the interface between the purge manifold 60 and the interface 62. Another optional inventive feature is that each powder supply 52 (such as for example a feed hopper or box) may be configured with the pumps 54 and the supply manifold 58 as a selectable and transportable assembly 80 so that following a purge operation a different material (or different source of a similar material) may be interfaced to provide powder to the guns 66. In this manner, the interface flexibility provided facilitates faster purge and material change times such as for color change for example.

A purge arrangement as a sub-combination of an overall material application system will be understood as including one or more of the common or supply manifolds 34, the change manifold 40 which has two or more outputs or outlets to the end use, and the purge manifold 36 (in the exemplary embodiment of FIG. 2). In the embodiment of FIG. 3, a purge arrangement sub-combination will be understood as including the purge manifold 60, one or more of the supply manifolds 58 and the interface 62. More generally stated then, an embodiment of a purge arrangement in accordance with one of the inventive aspects of this disclosure includes a purge manifold that can selectively be in fluid communication with a change manifold for a purging operation of two or more flow paths and outputs of the change manifold, and one or more supply manifolds that can be selectively in fluid communication with a change manifold for a supply operation to supply material through two or more flow paths and outputs of the change manifold.

Although the exemplary embodiments herein are described in the context of manual selection and interface of the various manifolds, it is also contemplated that such selection and interface may be performed automatically with appropriate robotic or other motion control devices that switch the various manifolds at appropriate times.

Figure 4:
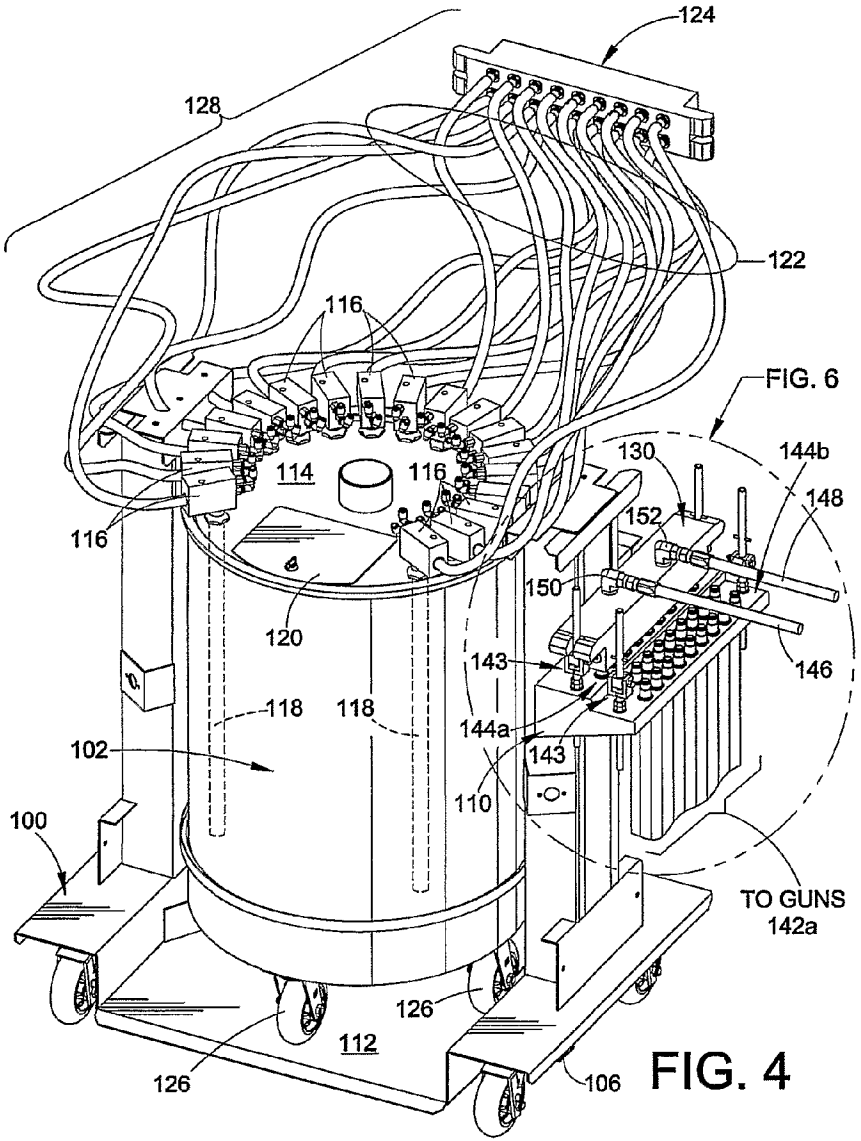
FIG. 4 is an isometric of an embodiment of a purge and powder change arrangement in a purge configuration.

With reference to FIG. 4, an exemplary embodiment of various inventive aspects of the disclosure is illustrated. Although this embodiment illustrates an eighteen gun system (optionally up to 36 guns), any number of guns may be accommodated as needed. The assembly illustrated in FIG. 4 corresponds to a purge configuration.

Figure 8:
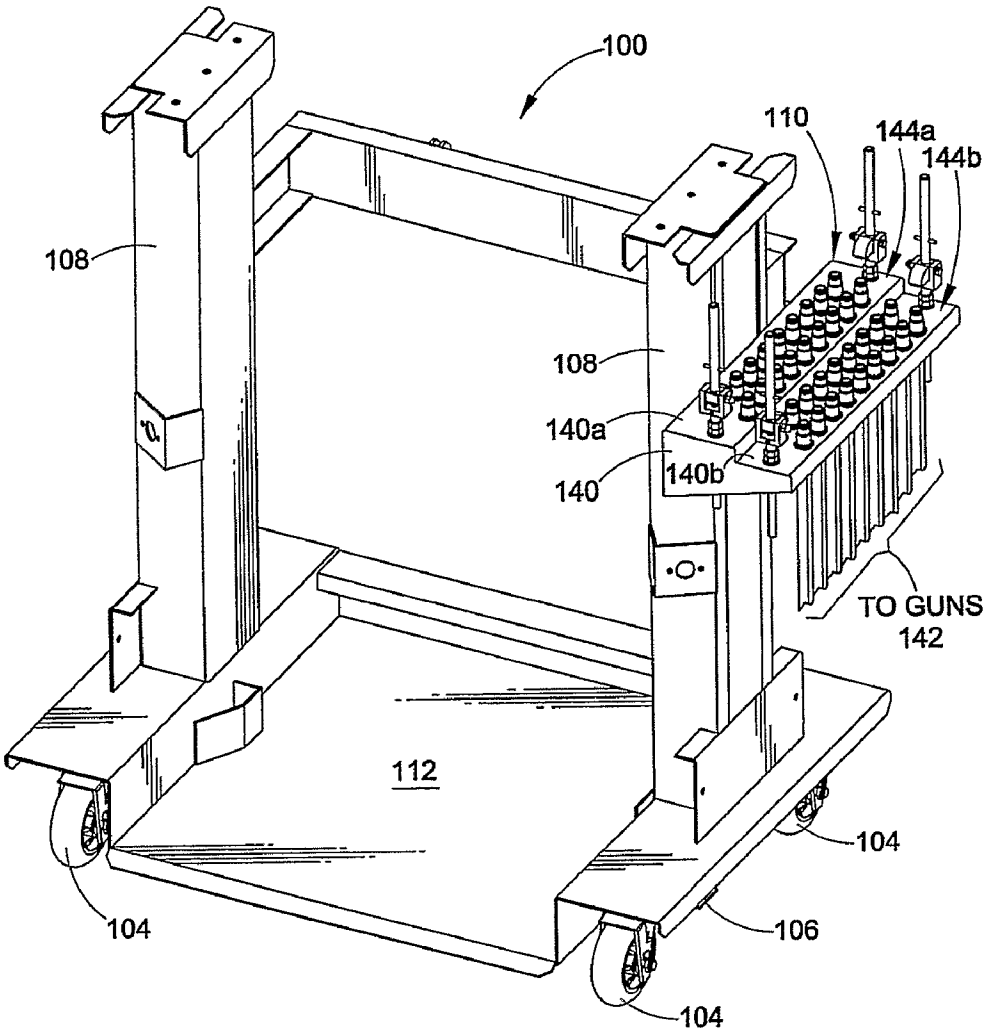
FIG. 8 illustrates an embodiment of a docking station.

A docking station 100 is provided that may be a sheet metal frame suitably adapted to support a feed hopper 102. The feed hopper 102 may be conventional in design or designed for a specific application. The feed hopper 102 essentially provides a supply of material, such as powder coating material, held within the hopper. FIG. 8 illustrates the docking station 100 with no hopper 102 installed. Wheels or casters 104 may be provided to facilitate movement of the docking station 100 within a facility. In this particular configuration, it is contemplated that the docking station 100 will be positioned near a spray booth (FIG. 11) and remain there. Thus, anchor tabs 106 may be provided to secure the docking station 100 to the floor or other stationary support.

The docking station 100 includes two or more upright stanchions or legs 108. A gun manifold or block 110 may be supported on one of the legs 108. Optionally, a second or more gun manifold (not shown) may be supported on the legs 108 and additional legs may be provided. The gun manifold 110 is an exemplary realization of the interface function 16/40/62 of FIGS. 1-3.

Although in all embodiments herein the gun manifold 110 is shown mounted on the docking station 100, alternatively the gun manifold 110 may be separately supported near the spray booth or even on the spray booth. This would allow the docking station 100 to be more mobile, or the docking station can be omitted altogether if a separate support is provided for the gun manifold 110. The docking station 100 may also include a platform 112 to support a hopper 102 thereon.

With reference again to FIG. 4, in this example the supply hopper 102 may include a cover 114 that supports a series of pumps 116. Each pump 116 may be, for example, a Venturi pump that sucks powder from the hopper 102 via a respective suction tube 18 (shown in phantom) that each extends down into the hopper 102. A lid 120 may be used to allow more powder to be added.

Each pump 116 has an associated pump or powder hose 122 associated therewith. Each pump hose 122 is connected at one end to its associated pump 116 outlet, and at an opposite end to a hopper manifold or block 124. Although FIG. 4 illustrates the hopper manifold 124 as apparently hanging out in air, in practice it may be rested on the cover 114 or supported on the docking station 100 in any conventional manner when not in use for a powder coating operation. Note that a hopper manifold 124 is an exemplary form of a supply manifold 34/58 (FIGS. 2 and 3 respectively).

The hopper 102 may be provided with wheels or casters 126 to facilitate transport and easy installation and removal of the hopper 102 onto the docking station platform 112.

The exemplary embodiments of FIGS. 4-11 presume that the docking station 100 is used and in general remains at or near the spray booth site. Thus, the hopper 102 having wheels simplifies interchanging different hoppers, for example, to effect a change of powder material such as a color change. However, alternatively, if the gun manifold 110 is otherwise supported off of the docking station 100, then a different hopper can simply be rolled up to the gun manifold 110. In any configuration, it is contemplated to be desired, although not required, that the hopper 102, pumps 116, powder hoses 122 and the hopper manifold 124 are arranged as a transportable assembly 128 (thus being, for example, one embodiment of the transportable assembly 80 of FIG. 3) and are transported together, whether a docking station 100 is used or not.

Figure 5:
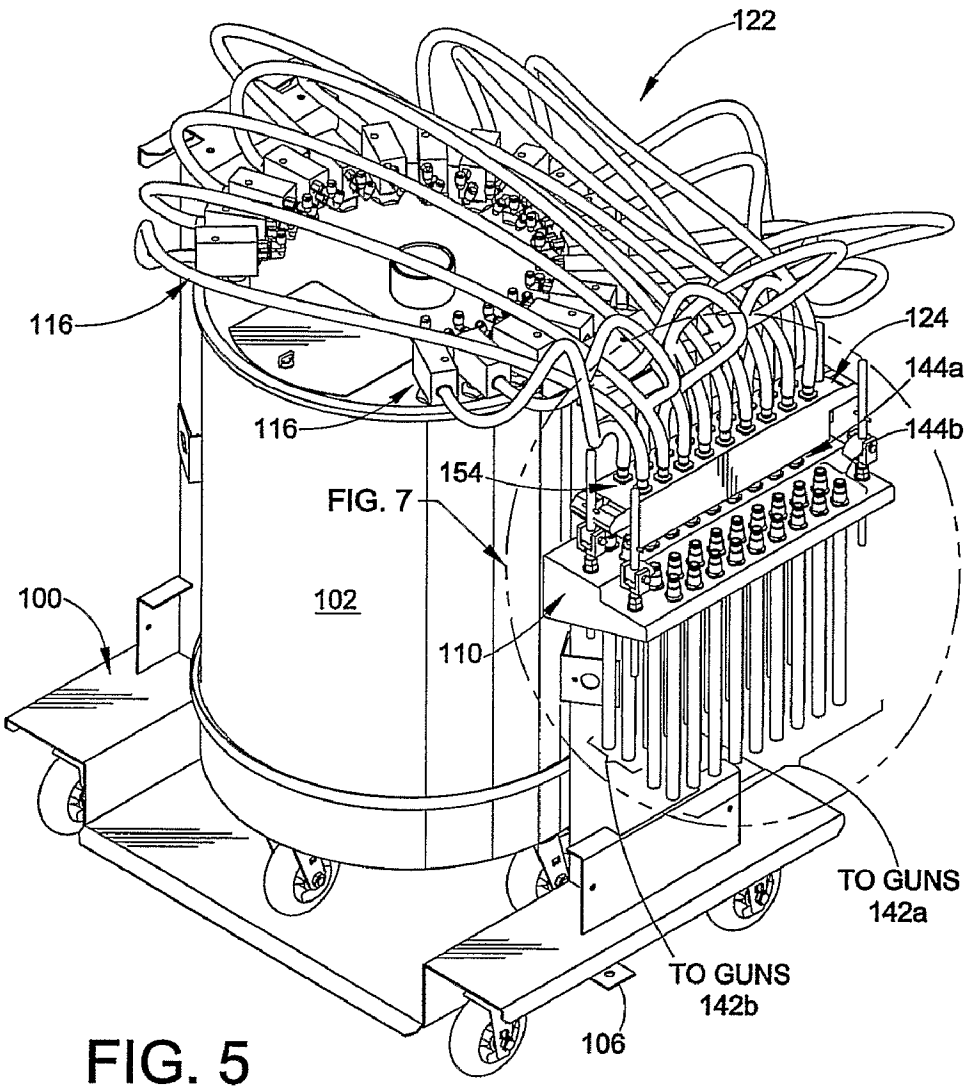
FIG. 5 is an isometric of an embodiment of a purge and powder change arrangement in a spray or supply configuration.

As noted, FIG. 4 illustrates a purge configuration, in which a purge manifold 130 is shown installed with the gun manifold 110. FIG. 5 illustrates a spray or coating configuration in which a selected hopper manifold 124 is installed with the gun manifold 110. In simple terms, an operator manually connects the hopper manifold 124 to the gun manifold 110 for a spray or coating operation (FIG. 5) and removes the hopper manifold 124 and installs the purge manifold 130 for a purge operation (FIG. 4). This manual selection is one realization of the selection function 20 discussed above with respect to FIGS. 1-3. In a coating configuration such as FIG. 5, the purge manifold (not shown) may be stowed in any convenient manner either on the docking station 100, the hopper 102 or elsewhere such as for example a stand near the spray booth or the spray booth itself.

With reference again to FIG. 8, the gun manifold 110 may be but need not be realized in the form of a single block or body 140. In this example the gun manifold 110 has been configured to accommodate eighteen guns at a time. The gun manifold 110 may be a two tiered block with for example the upper tier 140*a* being used for dark colors and the lower tier 140*b* used for light colors. This specific arrangement is highly optional as to the tiers, guns accommodated and so on. The primary function of the gun manifold 110 is to provide a preferably common connection site for establishing fluid communication between a plurality of gun hoses 142 and either the purge manifold 130 for purging or the hopper manifold 124 for powder feed. Thus, a very wide variety of configurations and embodiments for the gun manifold as well as the purge manifold and the hopper manifold can be envisioned.

Each tier 140*a*, 140*b* of the gun manifold 110 includes an array of docking nozzles 144, in this case there are eighteen nozzles 144, one for each gun hose 142. The docking nozzles 144 interface at one end to the hopper/purge manifolds 124/130 and at an opposite end to the gun hoses 142. Cam mechanisms 143 or other suitable arrangements are provided to securely install the selected hopper/purge manifolds to the gun manifold 110. The gun manifold 110 thus acts as the interface function 16/40/62 of FIGS. 1-3, and an operator selects the configuration by installing either the hopper manifold 124 or the purge manifold 130 onto the gun manifold 110 (thus effecting the "switch 20" operation of FIGS. 1-3).

Prior to powder being fed through the gun manifold 110, the purge manifold 130 may be installed onto the tier that will next be used and the powder paths including all the lines and guns purged. The purge manifold 130 is then removed and the next hopper manifold 124 installed onto the same tier or set of nozzles 144 just purged.

Figure 7:
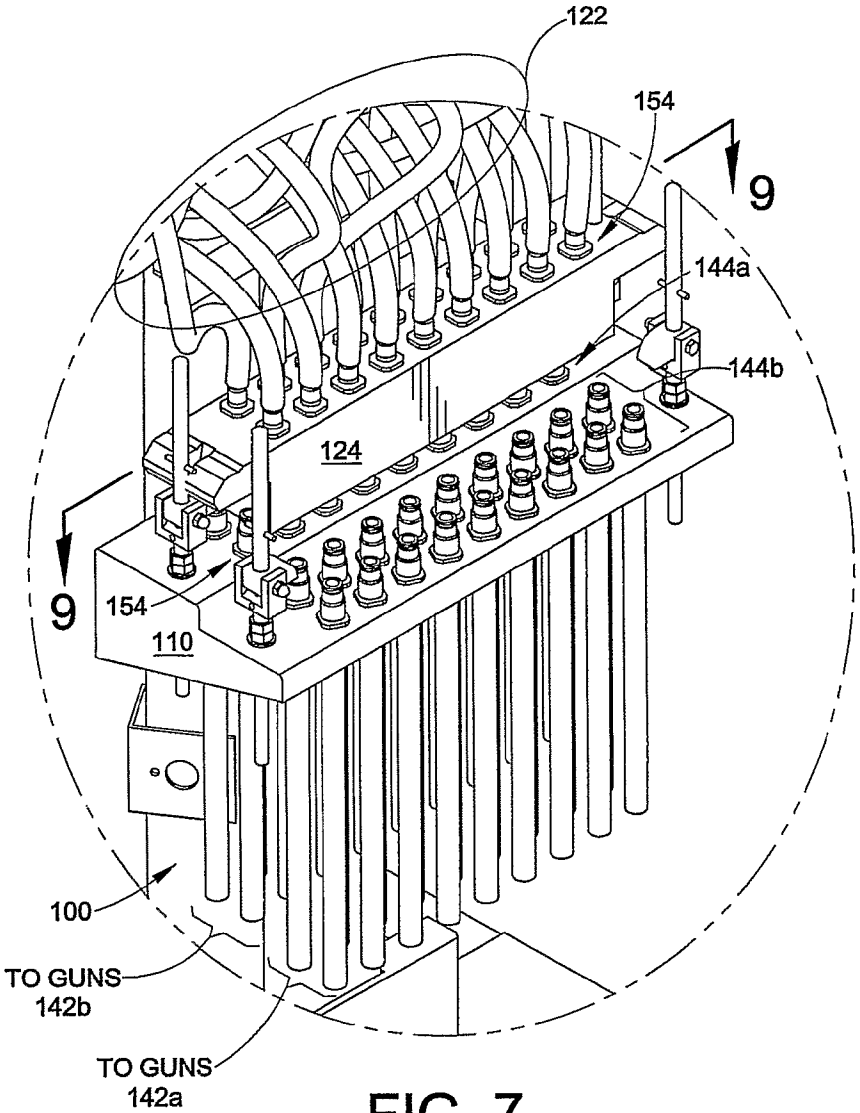
FIG. 7 is an enlarged view of a manifold arrangement for supply.

As best illustrated in FIGS. 5 and 7, each array of eighteen nozzles 144*a* and 144*b* on the two tiers has its own corresponding set of gun hoses 142*a* and 142*b* that run out to the spray guns. Thus, one tier 140 may be used for a spraying operation while the other is being purged, or both may be used for the same operation (spray or purge) at the same time. To reduce the demand for compressed air, the purge manifold 130 may optionally include two purge inlets 146, 148 so that nine lines are purged at a time. Other groupings may be optionally chosen as needed.

Figure 6:
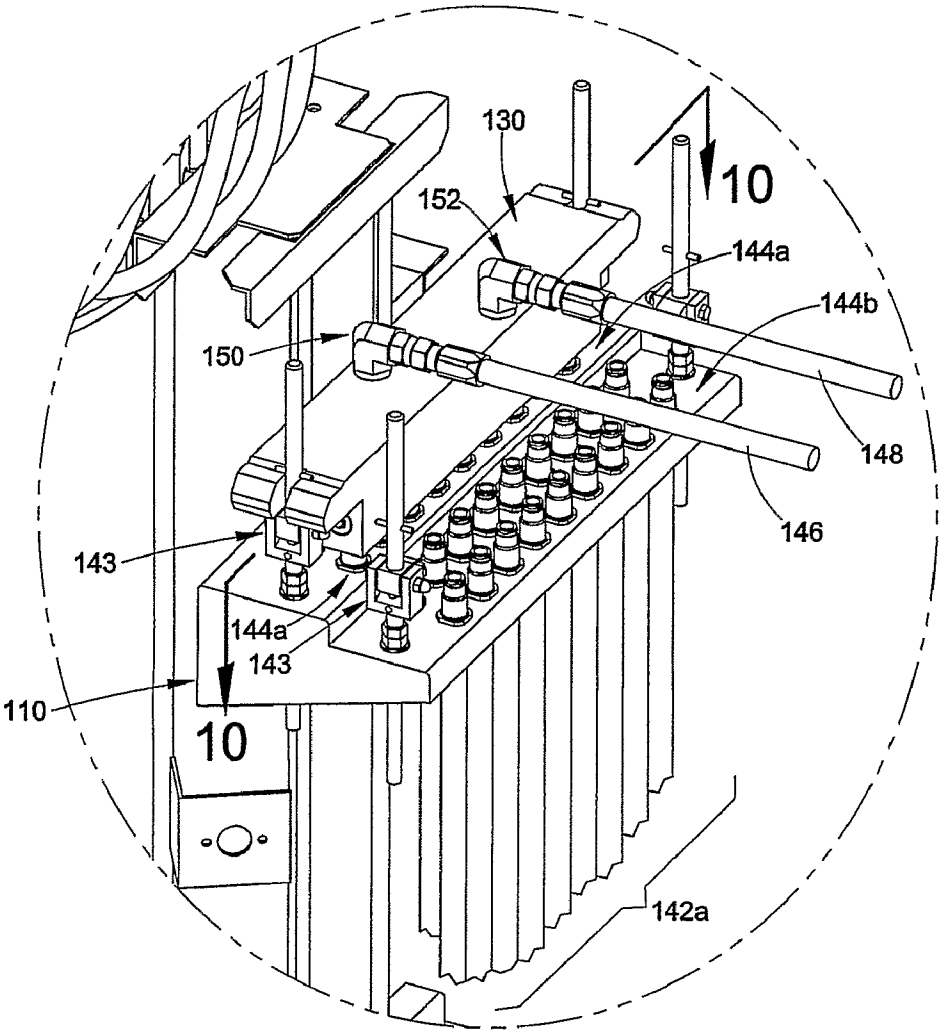
FIG. 6 is an enlarged view of a manifold arrangement for purge.

FIG. 6 illustrates an enlarged view of the interface between the purge manifold 130 and the gun manifold 110 for a purge operation of the back set of gun hoses 142*b* and the spray guns. Thus, the purge manifold 150 is installed on the upper tier 140*a*. The purge gas inlet lines 146, 148 are coupled to the purge manifold 130 by appropriate fittings 150, 152. Purging may thus be used to purge a powder flow path defined by the nozzles 144, the gun hoses 142 and the spray guns.

FIGS. 5 and 7 illustrate a configuration that may be used for a spray coating operation. Presuming the upper tier 140*a* has been purged, if needed a hopper manifold 124 is installed onto the gun manifold 110 on the appropriate tier 140*a* or 140*b*. When these manifolds are assembled together, a complete powder flow path is presented from the hopper 102, through the pumps 116 and pump hoses 122, into and through the hopper manifold 124, through the nozzles 144 of the gun manifold 110, into the gun hoses 142 and to the spray guns. It may be desired in some cases to design the interface between the hopper manifold 124 and the gun manifold 110 to provide a seamless or near seamless flow path to reduce entrapment and to facilitate purge. The hopper manifold 124 may include a respective number of pump hose connectors 154 connected at respective ends to the pump hoses 122, and at their other ends to the respective nozzles 144 when the manifolds are assembled. Although the exemplary embodiments illustrate that the number of pumps 116, pump hoses 122, pump hose connectors 154, nozzles 144 and gun hoses 142 are all the same and used together, such is not required.

Figure 9:
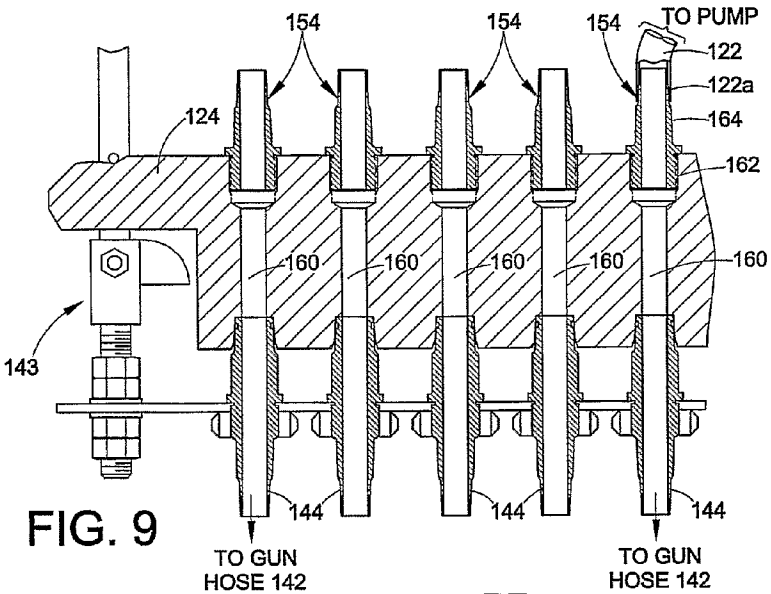
FIG. 9 is a cross-section taken along line 9-9 of FIG. 7.

With reference to FIG. 9, an exemplary interface between the hopper manifold 124 and the gun manifold 110 is illustrated taken along cross-section 9-9 of FIG. 7. The hopper manifold 124 may include a plurality of bores 160, one for each pump hose 122 (only shown in FIG. 9). Each hose connector 154 is received at an enlarged end 162 of its respective bore 160, and a nipple 164 extends outward to receive the hose end 122*a*. The connectors 154 may be made of any suitable material, for example plastic. The manifold blocks 124, 110, 130 may be made of any suitable material, such as for example, aluminum.

The nozzles 144 are each received or installed in the gun manifold 110. Each nozzle 144 extends out of the gun manifold and mates into a lower end of a respective bore 160 of the hopper manifold 124 when the manifolds are joined. Because the nozzles 144 may see extensive make and remake of the connections with various hopper manifolds 124, they may be made of more durable material such as stainless steel. Opposite ends of the nozzles 144 are connected to the respective gun hoses 142.

Figure 10:
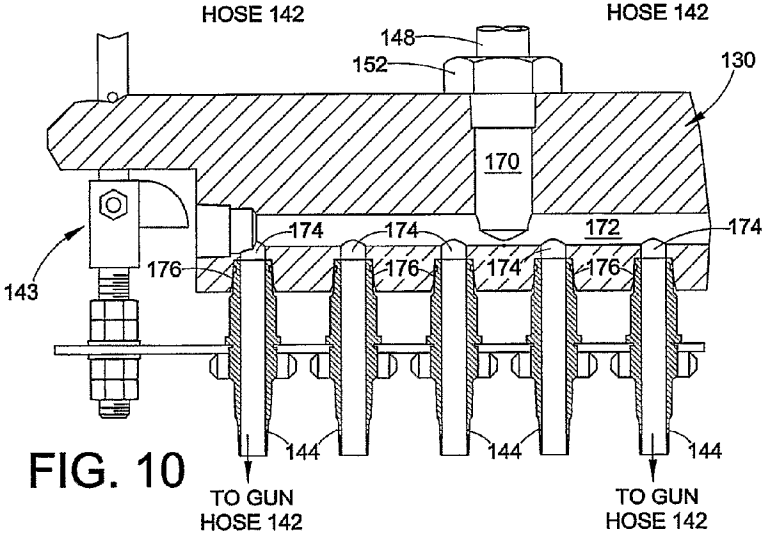
FIG. 10 is a cross-section taken along line 10-10 of FIG. 6.

With reference to FIG. 10, an exemplary interface between the purge manifold 130 and the gun manifold 110 is illustrated along cross-section 10-10 in FIG. 6. The purge manifold 130 includes two purge inlet bores 170 (only one shown in FIG. 10). Each bore 170 opens to a common passage 172 that communicates with a plurality of purge outlet passages 174. In this manner, a plurality of lines and guns can be purged together. Each purge outlet passage 174 ends at an enlarged bore 176 that receives a respective nozzle 144 end when the two manifolds are assembled.

Figure 11:
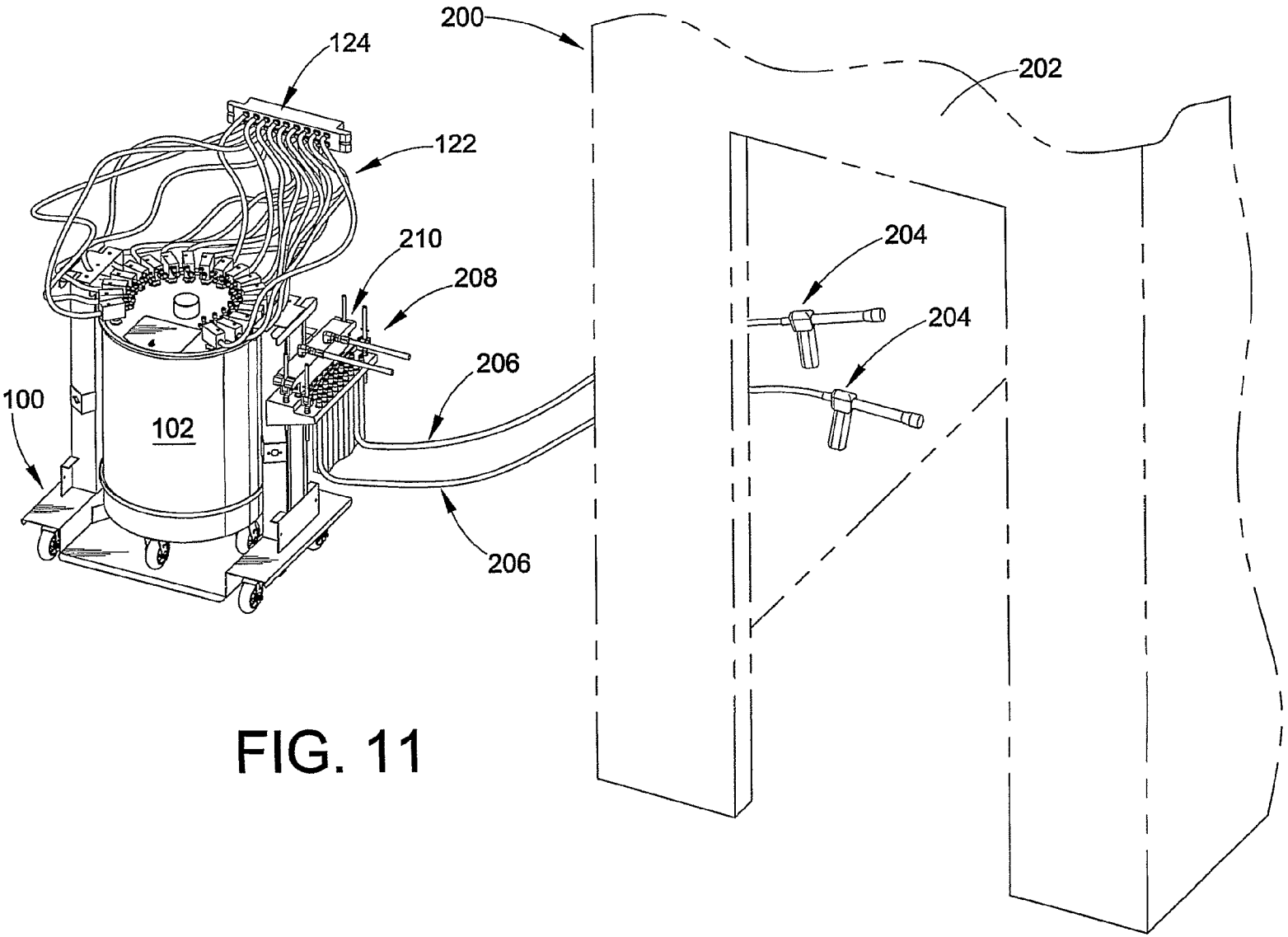
FIG. 11 is a simplified schematic of a powder coating application system.

FIG. 11 illustrates an overall material application system 200 including a spray booth 202, spray gun 204, gun hose 206 extending to a gun manifold 208 and a purge manifold 210 installed.

Although the various manifolds are illustrated as unitary blocks, one or more of them may be realized as multi-piece assemblies or arrangements to provide the desired flow paths, and blocks or manifolds need not be used to achieve the same overall function and benefits of the inventions herein.

The invention claimed is:

1. A powder coating system, comprising:

a supply block that is in fluid communication with a source of powder coating material;

a purge block that is in fluid communication with a source of purge gas;

a change block having two or more outputs, each of said two or more outputs being connected by a hose to a powder spray gun, said change block being selectively assembled to either said supply block or said purge block;

said two or more outputs of said change block being capable of being purged by said purge gas when said purge block is assembled to said change block; and said two or more outputs of said change block being capable of supplying material to said spray guns when said change block assembled to said supply block.

2. The powder coating system of claim 1 wherein said two or more outputs of said change block are purged at the same time.

3. The powder coating system of claim 1 comprising one or more purge inlets to said purge block and two or more outlets from said purge block.

4. The powder coating system of claim 1 wherein said supply block comprises a plurality of flow paths for a plurality of sources of material.

5. The powder coating system of claim 1 wherein said supply block and said purge block are selectively assembled one at a time to a common location on said change block.

6. The powder coating system of claim 1 wherein said supply block and purge block are manually installed on said change block at different times to change between a purge configuration and a supply configuration.

7. Powder coating system, comprising:

a first supply of powder material and a second supply of powder material, said first supply having a first supply manifold and said second supply having a second supply manifold;

a purge manifold;

at least two spray guns;

a change manifold having individual outlets for each spray gun;

said first supply manifold in fluid communication with said change manifold during a first coating operation, said second supply manifold in fluid communication with said change manifold during a second coating operation, said purge manifold in fluid communication with said change manifold during a purge operation, whereby all said spray guns are purged by establishing fluid communication between said purge manifold and said change manifold.

8. The system of claim 7 wherein said spray guns are purged at the same time.

9. The system of claim 7 comprising gun hoses each respectively connected between one of said spray guns and one of said individual outlets.

10. The system of claim 7 wherein said change manifold and one of said supply manifolds, when in fluid communication with each other, form powder flow paths from a supply of powder material to said spray guns.

11. The system of claim 10 comprising a gun hose in each said powder flow path between said change manifold and a spray gun.

12. The system of claim 7 wherein said change manifold and said purge manifold, when in fluid communication with each other form a purge path for purge air to purge said change manifold and said spray guns.

13. A powder coating system, comprising:

a change manifold having two or more outlets, each of said two or more outlets being connected by a hose to a powder spray gun;

a supply manifold having one or more inlets, each of said one or more inlets being in fluid communication with a source of powder coating material, and each of said one or more inlets being in fluid communication with one of said two or more outlets of said change manifold during a powder coating operation;

a purge manifold having a purge air path in fluid communication with said two or more outlets of said change manifold during a purge operation;

said change manifold being selectively assembled one at a time to either said supply manifold or said purge manifold.

14. The powder coating system of claim 13 wherein said change manifold provides a common location for establishing fluid communication with a selected one of said purge manifold or said supply manifold.

15. The powder coating system of claim 13 wherein said supply manifold is connectable to a plurality of powder pumps.

16. The powder coating system of claim 15 wherein said change manifold is connectable to a plurality of spray guns and associated gun hoses.

17. The powder coating system of claim 16 wherein said gun hoses and spray guns may be purged at the same time.

18. The powder coating system of claim 13 comprising a second supply manifold for a different color of material to said change manifold outlets during a different powder coating operation.

* * * * *